US008813721B2

(12) United States Patent
Kato et al.

(10) Patent No.: US 8,813,721 B2
(45) Date of Patent: Aug. 26, 2014

(54) PRESSURE FLUCTUATION CONTROL DEVICE FOR CONTROLLING PRESSURE FLUCTUATION IN UPSTREAM SIDE OF COMMON RAIL

(75) Inventors: Kensho Kato, Kanagawa (JP); Hisao Ogawa, Kanagawa (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 650 days.

(21) Appl. No.: 13/143,959

(22) PCT Filed: Oct. 16, 2009

(86) PCT No.: PCT/JP2009/067884

§ 371 (c)(1),
(2), (4) Date: Jul. 13, 2011

(87) PCT Pub. No.: WO2010/084651

PCT Pub. Date: Jul. 29, 2010

(65) Prior Publication Data

US 2011/0259301 A1 Oct. 27, 2011

(30) Foreign Application Priority Data

Jan. 26, 2009 (JP) ..... 2009-014746

(51) Int. Cl.

| | |
|---|---|
| ***F02M 63/00*** | (2006.01) |
| ***F02M 69/46*** | (2006.01) |
| ***F02M 55/04*** | (2006.01) |
| ***F02M 55/02*** | (2006.01) |
| ***F02M 63/02*** | (2006.01) |
| *F02D 41/00* | (2006.01) |
| *F02D 41/38* | (2006.01) |

(52) U.S. Cl.

CPC ..... *F02M 55/04* (2013.01); *F02M 69/465* (2013.01); *F02D 41/3845* (2013.01); *F02D 41/3809* (2013.01); *F02M 55/025* (2013.01); *F02M 63/0285* (2013.01); *F02M 2200/315* (2013.01); *F02M 2200/40* (2013.01)

USPC ..... 123/447; 123/456

(58) Field of Classification Search

CPC . F02M 55/04; F02M 69/465; F02M 63/0225; F02M 22/315; F02M 2200/40; F02M 63/023; F02D 41/3809; F02D 41/3845

USPC ..... 123/447, 446, 445, 456, 457, 506, 511

See application file for complete search history.

(56) References Cited

U.S. PATENT DOCUMENTS

| | | | | |
|---|---|---|---|---|
| 5,538,403 | A | 7/1996 | Black | |
| 6,016,791 | A * | 1/2000 | Thomas et al. | 123/456 |
| 7,334,571 | B1 * | 2/2008 | Beardmore | 123/456 |
| 7,540,275 | B2 * | 6/2009 | Otani et al. | 123/508 |
| 7,627,416 | B2 * | 12/2009 | Batenburg et al. | 701/103 |
| 8,528,522 | B2 * | 9/2013 | Li | 123/456 |
| 8,539,934 | B2 * | 9/2013 | Kaneko | 123/447 |
| 2004/0154594 | A1 | 8/2004 | Miyashita | |
| 2007/0186907 | A1 | 8/2007 | Otani et al. | |
| 2009/0223486 | A1 | 9/2009 | Weizenauer et al. | |
| 2009/0277420 | A1 | 11/2009 | Otani et al. | |

FOREIGN PATENT DOCUMENTS

| | | |
|---|---|---|
| DE | 10 2006 003 639 | 8/2007 |
| EP | 0 685 644 | 12/1995 |
| EP | 0 699 835 | 3/1996 |
| EP | 1 143 140 | 10/2001 |
| EP | 1 783 355 | 5/2007 |
| GB | 482610 | 4/1938 |
| JP | 5-149209 | 6/1993 |
| JP | 7-054731 | 2/1995 |
| JP | 8-68368 | 3/1996 |
| JP | 9-329069 | 12/1997 |
| JP | 11-062772 | 3/1999 |
| JP | 2001-107822 | 4/2001 |
| JP | 3531896 | 5/2004 |
| JP | 2004-239168 | 8/2004 |
| WO | 2005/038234 | 4/2005 |
| WO | 2008/037794 | 4/2008 |

OTHER PUBLICATIONS

International Preliminary Report on Patentability and Written Opinion of the International Searching Authority issued Jul. 26, 2011 in International (PCT) Application No. PCT/JP2009/067884 with English translation.

International Search Report issued Dec. 15, 2009 in International (PCT) Application No. PCT/JP2009/067884.
Extended European Search Report issued Dec. 4, 2013 in corresponding European Patent Application No. 09838841.6.

* cited by examiner

*Primary Examiner* — Hieu T Vo
(74) *Attorney, Agent, or Firm* — Wenderoth, Lind & Ponack, L.L.P.

(57) ABSTRACT

A device for controlling a variation in pressure upstream of a common rail, the device being an extremely simple and small-sized compact device which is used in a pressure accumulating common rail type fuel injection apparatus. The device for controlling a variation in pressure upstream of a common rail can supply high-pressure fuel to the common rail in a stable pressure state by preventing pulsation of a high-pressure pump from occurring in each cylinder of the pump and also preventing generation of a surge pressure caused by opening and closing of a check valve. The device is provided with a secondary common rail which is connected to the fuel outlets of the check valves each provided to each of the cylinders of the high-pressure pump and which has a volume equal to or less than the volume of the common rail, and the device is also provided with injection pipes which connect between the common rail and the fuel outlets of the secondary common rail. The number of the injection pipes is set to be less than the number of the check valves each provided to each of the cylinders of the high-pressure pump.

5 Claims, 7 Drawing Sheets

PRESSURE FLUCTUATION CONTROL DEVICE FOR CONTROLLING PRESSURE FLUCTUATION IN UPSTREAM SIDE OF COMMON RAIL

BACKGROUND OF THE INVENTION

1. Field of the Invention

The present invention is applied to a fuel injection system of diesel engines, the injection system being a common rail fuel injection system; thereby, a high pressure pump pressurizes fuel oil, and the pressurized fuel oil is sent to and accumulated in the common rail (an accumulator volume); a prescribed amount of the highly pressurized fuel oil accumulated in the common rail is injected into each cylinder of the engine, through the fuel injector (a fuel injection valve), at predetermined timing or timings for predetermined duration of time; the present invention relates to a pressure fluctuation control device for controlling the pressure fluctuation in the upstream side of a common rail in the common rail fuel injection system (an accumulator injection system).

2. Background of the Invention

In the common rail (an accumulator volume) fuel injection device depicted in FIGS. 5(A), 5(B), 6 and 7, a high pressure pump 3 pressurizes fuel oil; and, the pressurized fuel oil is sent to and accumulated in a common rail (an accumulator volume) 1; a prescribed amount of the highly pressurized fuel oil accumulated in the common rail is injected into each cylinder at predetermined timing or timings for predetermined duration of time, per each cylinder, through a fuel injector 6 (a fuel injection valve) corresponding to the cylinder, the fuel injector communicating with the common rail through a fuel injection pipe 12 corresponding to the cylinder; thereby, the predetermined timing and the predetermined duration are determined on the basis of the engine operation condition and the firing timing of the cylinder.

As shown in FIG. 5(A), a plurality of cylinders (3 cylinders in this case) is provided in the high pressure pump 3; each cylinder (of the pump 3) pressurizes the fuel oil; at the fuel outlet of each cylinder, a check valve 10 is provided so as to open and close the fuel passage of the check valve; after passing through the check valves 10, the high pressure fuel oil is sent to a plurality of pressure accumulation rooms 16 (3 rooms in this case); in the pressure accumulation rooms 16, the surging pressures (or pressure fluctuations) regarding the delivery pressure of the fuel delivered by the pump 3 are relieved; then, the fuel oil is guided into the common rail 1 through a plurality of high pressure pipes 23 (3 pipes in this case).

Since the configuration as to the downstream side of the fuel-flow from the common rail toward each cylinder of the engine is a configuration of public knowledge, detailed explanations are omitted; however, it is noted that a prescribed amount of the highly pressurized fuel oil accumulated in the common rail is injected into each cylinder of the engine, at predetermined timing or timings (according to each cylinder's injection timing) predetermined duration of time per cylinder of the engine, through a fuel injector 6 (a fuel injection valve) corresponding to the cylinder of the engine; the fuel injector communicates with the common rail through a fuel injection pipe 12 in response to the corresponding cylinder of the engine; thereby, the predetermined timing (injection timing) and the predetermined duration are determined on the basis of the engine operation condition and the firing timing of the cylinder.

Further, as shown in FIG. 7, the multiple check valves 10 are provided so that the number of check valves is equal to the number of cylinders in the high pressure pump 3 that delivers high pressure fuel oil; while the pressure of the pressurized fuel oil is not lower than a certain pressure established by a spring 10*b* and a valve body 10*a* that are housed in a spring chamber 10*c*, the high pressure fuel oil can stream toward an upstream side 10*e*; on the other hand, the check valve 10 prevents the high pressure fuel oil from back-flowing to a delivery chamber 3*b* from the upstream side 10*e*.

The check valve 10 is provided with a case 10*f* housing the components of the check valve 10; the case 10 is fastened to a case (a high pressure pump body) 3*d* of the high pressure pump 3, by use of a plurality of bolts 10*d*.

The high pressure fuel oil passing through the check valve 10 is sent to the common rail 1.

In addition, the high pressure pump 3 supplies the high pressure fuel oil toward the check valve 10, by pressurizing the fuel oil in the delivery chamber 3*b* through the reciprocating movements which a plunger 3*a* performs slidably in the case 3*d*, the reciprocating movements being driven by a tappet 3*c*.

In FIG. 5(B), the pressure accumulation rooms 16 in FIG. 5(A) are integrated into a pressure accumulation room 16*a* of an integral type, the integration being performed per a plurality of cylinders (3 cylinders in this case) of the high pressure pump 3; thus, the volume of the pressure accumulation rooms 16 is increased into the volume of the pressure accumulation room 16*a*; as a result, the effect on the surging pressure reduction is enhanced.

The other configuration in FIG. 5(B) is the same as that in FIG. 5(A); and, the check valve 10 depicted in FIG. 5(A) and the check valve 10 depicted in FIG. 5(B) have the same configuration as depicted in FIG. 7; the same component is quoted with the same numeral.

The patent reference JP3531896 discloses a common rail injection system in which a secondary common rail 10 (a sub-common-rail) is provided at an end side of the common rail 5, the secondary common rail 10 being connected to the common rail 5 through a high pressure pipe (other than the fuel injection pipes) and an open-close valve (an on-off valve) 11 on a part way of the high pressure pipe.

The configuration depicted in FIG. 6 is similar to that depicted in FIG. 5(A); however, in the case of FIG. 6, the length of each high pressure pipe 23*b* that connects each pressure accumulation room to the common rail 1 is reduced in comparison with the case of FIG. 5(A); thus, the reduction of the surging pressures is aimed at.

The other configuration in FIG. 6 is the same as that in FIG. 5(A); and, the check valve 10 depicted in FIG. 5(A) and the check valve 10 depicted in FIG. 6 have the same configuration as depicted in FIG. 7; the same component is quoted with the same numeral.

As described above, in the common rail (an accumulator) fuel injection device, the high pressure pump 3 pressurizes fuel oil; and, the pressurized fuel oil is sent to and accumulated in the common rail (the accumulator volume) 1; a prescribed amount of the highly pressurized fuel oil accumulated in the common rail is injected into each cylinder of the engine at predetermined timing or timings for predetermined duration of time, per engine cylinder, through the fuel injector 6 (the fuel injection valve) corresponding to the cylinder; thereby, the predetermined timing or timings and the predetermined duration are determined on the basis of the engine operation condition and the firing timing of the cylinder.

On the other hand, it is an urgent matter to restrain the pumping pulsation (pressure pulsation) at every cylinder of the high pressure pump 3 that comprises a plurality of cylinders; each cylinder pressurizes the fuel oil; the check valve 10 is provided at the outlet of each cylinder of the pump 3 so as to open and close the fuel passage of the check valve; further, it is also an urgent matter to reduce the surging pressure that is generated in opening and closing the check valve 10. To be more specific, in a case of the small engines for vehicle use or generator use, the engines have to be compact and are strongly required to restrain the pumping pulsations and the surging pressures.

In view of the requirement as described above, the means as depicted in FIGS. 5(A), 5(B), 6 and 7 are conventionally provided; however, according the fuel injection device of FIG. 5(A), as many (3 cylinders in this case) pressure accumulation rooms 16 are provided as there are cylinders of the high pressure pump 3; accordingly, the volume of each pressure accumulation room 16 has to be large enough to satisfactorily reduce the pumping pulsations and the surging pressures; thus, the size of the high pressure pump 3 has to be upsized. Further, according the fuel injection device of FIG. 5(B), the pressure accumulation rooms 16 are integrated into a pressure accumulation room 16*a* of an integral type so as to reduce the pumping pulsations and the surging pressures; thereby, the shape of the accumulation room 16*a* of an integral type becomes complicated and upsized; moreover, the prevention against the leakage of the high pressure fuel oil becomes difficult in view of the design of the accumulation room 16*a*; and, the degree of accuracy in finishing the accumulation room 16*a* has to be enhanced.

Further, according the fuel injection device of FIG. 6, the length of each high pressure pipe 23*b* that connects each pressure accumulation room to the common rail 1 is reduced in comparison with the corresponding length in the conventional fuel injection device; thus, the reduction of the inertia mass regarding the fuel oil in the pipe 23 is aimed at, in order to reduce the pumping pulsations and the surging pressures. However, it is often difficult to reduce the length of the high pressure pipe 23*b* because of the constraint conditions regarding the system layout (the arrangements of the common rail injection system).

As described thus far, in the accumulator injection device provided with the common rail 1, multiple cylinders of the high pressure pump 3 pressurizes the fuel oil; at the fuel outlet of each cylinder, the check valve 10 is provided so as to open and close the fuel passage of the check valve. In a case where the pumping pulsations generated at each cylinder as well as the surging pressures generated by the on-off movements of the check valve 10 is reduced in the pressure accumulation room 16 or 16*a* on the upstream side of the common rail 1, the volume of the pressure accumulation room 16 or 16*a* on the upstream side of the common rail 1 has to be large enough in order to satisfactory reduce the pumping pulsations and the surging pressures.

REFERENCES

Patent References

Patent Reference: JP3531896

SUMMARY OF THE INVENTION

Subjects to be Solved

In view of the difficulties in the conventional technologies as described above, the present invention aims at providing a pressure fluctuation control device with a simple and compact configuration so that the pressure fluctuations in the upstream side of a common rail is controlled, in order that the pumping pulsation generated by the movement of each cylinder of the high pressure pump as well as the surging pressure vibration generated by the pressure fluctuation working on the check valves is controlled, and the high pressure fuel oil can be supplied to the common rail under a stable pressure condition.

Means to Solve the Subjects

In order to overcome the difficulties as described above, the present invention discloses a pressure fluctuation control device for controlling the pressure fluctuation in the upstream side of a common rail in an accumulator injection system, the device may include, but is not limited to: a high pressure pump may be including, but not limited to, a plurality of cylinders in which fuel oil is pressurized to a certain level of high pressure, and a check valve that is provided at a fuel outlet of each cylinder so as to open and close the fuel passage of the check valve; a common rail that accumulates the pressurized fuel oil delivered by the high pressure pump; and a fuel injector that is provided at each cylinder of the engine so that a prescribed amount of the highly pressurized fuel oil accumulated in the common rail is injected into each cylinder of the engine through the fuel injector; wherein the pressure fluctuation control device may further include, but is not limited to: a secondary common rail that is connected to the fuel outlet of the check valve corresponding to each cylinder of the high pressure pump, the accumulation volume being smaller than or equal to the accumulation volume of the common rail; and at least one high pressure pipe that connects the fuel outlet of the secondary common rail to the common rail, the number of high pressure pipes being smaller than the number of check valves corresponding to the cylinders of the high pressure pump.

A preferable embodiment of the present invention is the pressure fluctuation control device for controlling the pressure fluctuation in the upstream side of a common rail in an accumulator injection system, the device being further provided with at least one common rail other than the already provided common rail, and each common rail is provided with the secondary common rail, and each secondary common rail is connected to the corresponding common rail via at least one high pressure pipe, the number of high pressure pipes being less than the number of the check valves provided to the cylinders of the high pressure pump.

Another preferable embodiment of the present invention is the pressure fluctuation control device for controlling the pressure fluctuation in the upstream side of a common rail in an accumulator injection system, the device being further provided with at least one pressure accumulation room for reducing pumping pulsation of the pressurized fuel oil between the secondary common rail and the fuel outlet of the check valve provided to each cylinder of the high pressure pump.

Another preferable embodiment of the present invention is the pressure fluctuation control device for controlling the pressure fluctuation in the upstream side of a common rail in an accumulator injection system, in which one pressure accumulation room is provided to each of the fuel outlet of the check valve provided to each cylinder of the high pressure pump, and each pressure accumulation room is connected to the secondary common rail.

Another preferable embodiment of the present invention is the pressure fluctuation control device for controlling the pressure fluctuation in the upstream side of a common rail in an accumulator injection system, in which the pressure accumulation rooms are integrated into one volume for the multiple outlets of the check valves, and the integrated pressure accumulation room being common to the check valves is connected to the secondary common rail.

Effects of the Invention

According to the present invention, in the pressure fluctuation control device for controlling the pressure fluctuation in the upstream side of a common rail in an accumulator injection system, the device is further provided with:

a secondary common rail that is connected to the fuel outlet of the check valve corresponding to each cylinder of the high pressure pump, the accumulation volume being smaller than or equal to the accumulation volume of the common rail;

at least one high pressure pipe that connects the fuel outlet of the secondary common rail to the common rail 1, the number of high pressure pipes being smaller than the number of check valves corresponding to the cylinders of the high pressure pump.

Thus, the pumping pressure vibrations of the high pressure fuel oil as well as the surge pressure vibrations due to the movements regarding the spring 10*b* and the valve body 10*a* of the check valve 10 are generated in the fuel oil delivered from the fuel outlet of each check valve 10; thereby, the pumping pressure vibrations are the pressure fluctuations which cycle relates to the numbers of cylinders of the high pressure pump 3 and the rotation speed of the high pressure pump 3. Further, the pumping pressure vibrations as well as the surge pressure vibrations are transmitted to the secondary common rail 2; thereby, the volume of the secondary common rail 2 is smaller than or equal to the volume of the common rail 1.

Further, the number of connecting pipes (the high pressure pipes) is smaller than the number of cylinders of the high pressure pump namely the number of check valves; thereby, the connecting pipe connects the common rail to the secondary common rail that has a volume smaller than or equal to the volume of the common rail. Accordingly, the cycle of the pumping pressure vibrations (fluctuations) transmitted to the fluid space in the secondary common rail relates to the numbers of check valves of the high pressure pump and the rotation speed of the high pressure pump. Thus, the pumping pressure fluctuations are transmitted to the common rail via the secondary common rail as well as via the high pressure pipe; thereby, the number of high pressure pipes is set smaller than the number of check valves arranged at the high pressure pump cylinders, and the passage area of the high pressure pipe is to be small enough to bring a throttle effect.

Hence, the pressure fluctuations are transmitted to the secondary common rail from the fuel inlet side thereof, namely, from the high pressure pump cylinder side or the check valve side; thereby, the cycle of the pumping pressure fluctuations relates to the numbers of pipes check valves of the high pressure pump and the rotation speed of the high pressure pump. Further, the throttle area regarding the outlet side (i.e. the high pressure pipe) of the secondary common rail is smaller than the throttle area regarding the inlet side (i.e. the connecting pipes) of the secondary common rail; in addition, the number of high pressure pipes is small enough to bring a throttle effect; in this way, the fuel oil accompanying the pressure fluctuations is sent into the common rail of a larger volume from the secondary common rail of a smaller volume, via the high pressure pipe with the small throat area.

Accordingly, the pressure fluctuation wave is absorbed in the secondary common rail; thereby, the pressure fluctuation wave relates to the numbers of check valves arranged at each cylinder of the high pressure pump and the rotation speed of the high pressure pump. After the fluctuation wave is absorbed in the secondary common rail, the fuel oil accompanying the pressure fluctuations is sent into the common rail, via the high pressure pipe, the number of high pressure pipes being smaller than the number of connecting pipes (and the throttle area of the high pressure pipe being small enough to bring a throttle effect).

Hence, in a simple and compact device where the secondary common rail which volume is smaller than the volume of the common rail is provided at the outlet sides of the check valves regarding the high pressure pump and the high pressure pipe is provided so that the number of high pressure pipes is smaller than the number of check valves provided at each cylinder of the high pressure pump, the delivery pressure fluctuations regarding the high pressure pump as well as the surge pressure vibrations regarding the check valves can be prevented. Thus, the fuel oil can be supplied to the common rail under a stable pressure condition.

Incidentally, the secondary common rail 10 (a sub-common-rail) in the patent reference JP3531896 is arranged at an end side of the common rail 5, the secondary common rail 10 being connected to the common rail 5 through a high pressure pipe (other than the fuel injection pipes) and an open-close valve (an on-off valve) 11 on a part way of the high pressure pipe. Thus, the secondary common rail 10 in the patent reference is aimed at increasing the volume of the common rail 5; accordingly, the secondary common rail on the present invention is different from the secondary common rail 10 in the patent reference.

According to a preferable embodiment of the present invention, the pressure fluctuation control device is further provided with at least one common rail other than the common rail in the present invention (as a parent claim), wherein each common rail is provided with the secondary common rail as described in the present invention; thereby, each secondary common rail is connected to the corresponding common rail via at least one high pressure pipe, the number of high pressure pipes being smaller than the number of check valves corresponding to the cylinders of the high pressure pump.

In this way, by providing a secondary common rail in response to each common rail, as well as, by supplying high pressure fuel oil accompanying pressure fluctuation wave from each secondary common rail to the corresponding common rail which volume is larger than the volume of the secondary common rail via at least one high pressure pipe having the small throttle area, the pressure fluctuation wave (vibration) can be absorbed in each secondary common rail; after passing through each secondary common rail, the high pressure fuel oil can enter each common rail corresponding to the secondary common rail, the pressure fluctuations being smoothed.

According to another preferable embodiment of the present invention, the pressure fluctuation control device is further provided with at least one pressure accumulation room for reducing the pumping pulsation of the pressurized fuel oil, between the secondary common rail and the fuel outlet of the check valve corresponding to each cylinder of the high pressure pump.

In this way, the pressure fluctuation wave (vibration) derived from each check valve corresponding to each cylinder of the high pressure pump is restrained; moreover, the pressure pulsation of the high pressure fuel oil is smoothed thanks to the volume effect of each pressure accumulation room; thus, the fuel oil can be sent to the common rail from the secondary common rail.

According to another preferable embodiment of the present invention, a pressure accumulation room is provided in response to the fuel outlet of the check valve corresponding to each cylinder of the high pressure pump, each pressure accumulation room being connected to the secondary common rail.

In this way, the pressure fluctuation wave (vibration) derived from each check valve corresponding to each cylinder of the high pressure pump is restrained; moreover, the pressure pulsation of the high pressure fuel oil is smoothed thanks to the volume effect of each pressure accumulation room; thus, the fuel oil can be sent to the common rail from the secondary common rail.

According to another preferable embodiment of the present invention, the pressure accumulation rooms are integrated in one volume per multiple outlets of the check valves; thereby, the integrated pressure accumulation room common among the check valves is connected to the secondary common rail.

In this way, since the multiple pressure accumulation rooms 16 are integrated into one pressure accumulation room per one high pressure pump so that the pressure accumulation room is formed as one volume, the integrated volume (the volume of the integrated pressure accumulation room) can be larger than the sum of the separated volumes; and, the pumping pulsation as well as the surging pressure vibration in the fuel oil sent to the common rail can be reduced.

As described thus far, based on the pressure fluctuation control device for controlling the pressure fluctuation in the upstream side of a common rail in an accumulator injection system according to the present invention, the degree of freedom as to the design of the high pressure pipes can be enhanced; thus, the present invention is also suitably applied to replacement projects (or replacement work) regarding the fuel injection systems of diesel engines into common rail injection systems (accumulator injection systems).

BRIEF DESCRIPTION OF THE DRAWINGS

The present invention will now be described in greater detail with reference to the preferred embodiments of the invention and the accompanying drawings, wherein.

DETAILED DESCRIPTION OF THE PREFERRED EMBODIMENTS

Hereafter, the present invention will be described in detail with reference to the embodiments shown in the figures. However, the dimensions, materials, shape, the relative placement and so on of a component described in these embodiments shall not be construed as limiting the scope of the invention thereto, unless especially specific mention is made.

First Embodiment

Figure 1:
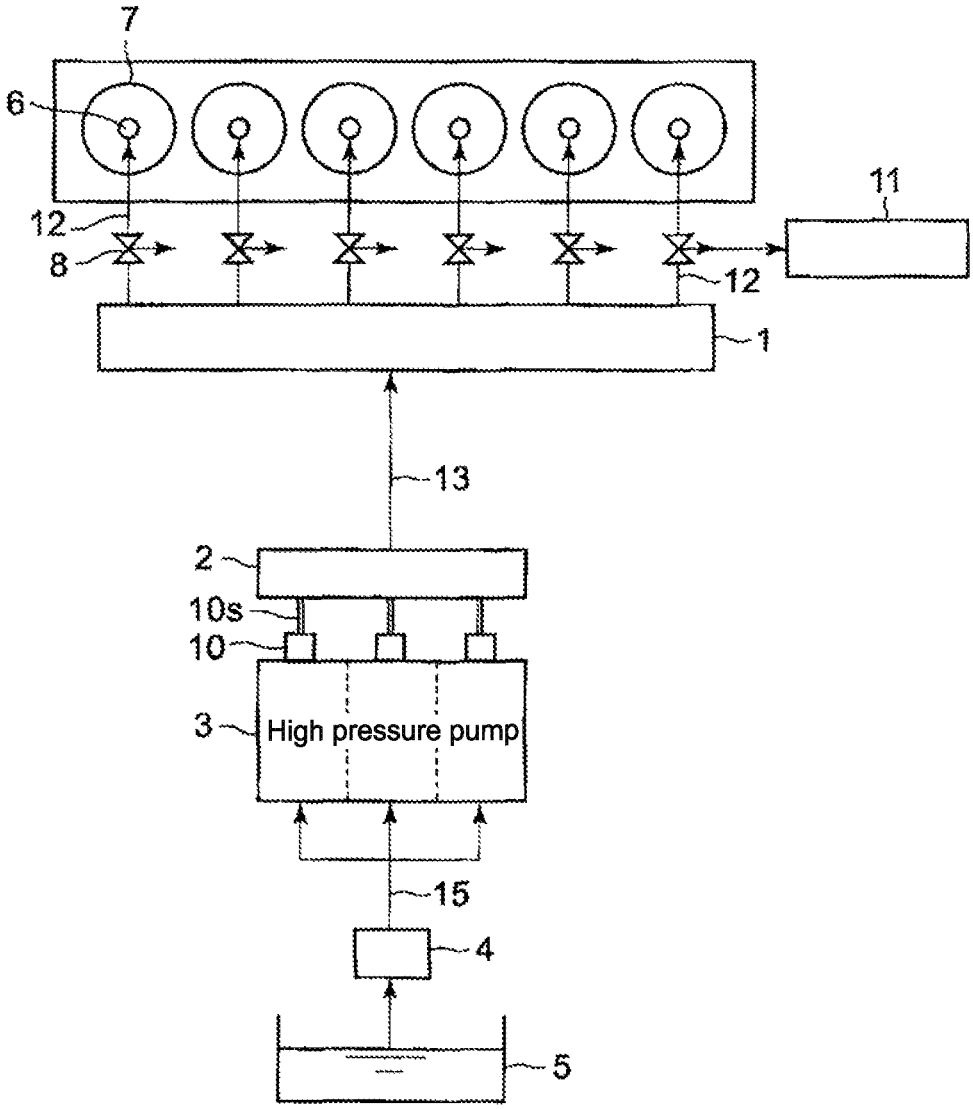
FIG. 1 shows the major configuration of a common-rail injection device according to a first embodiment of the present invention.
Figure 2:
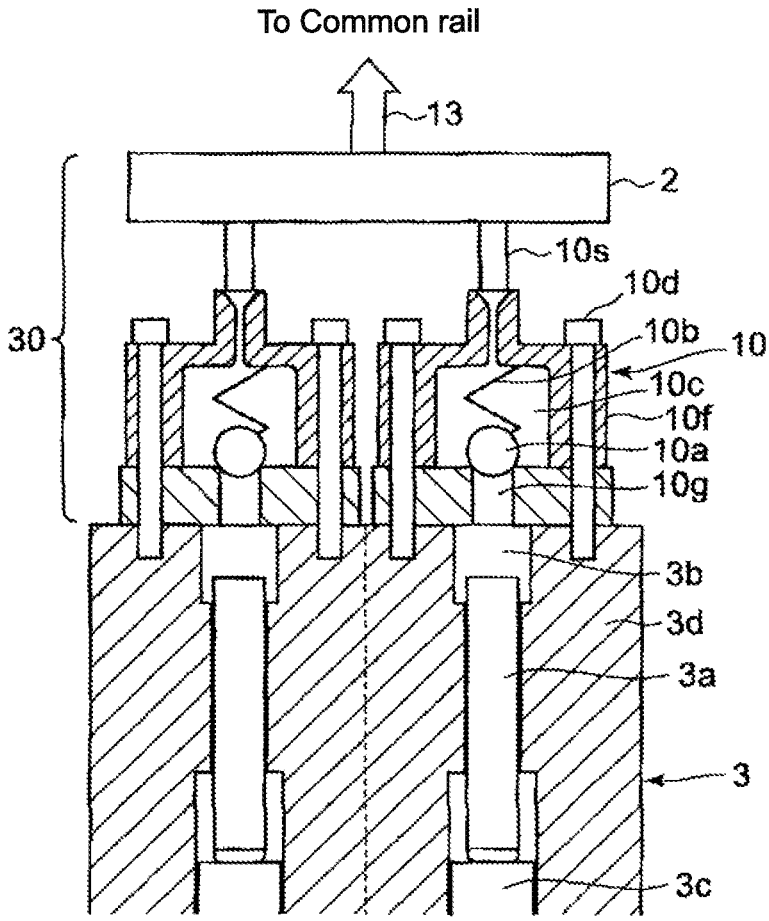
FIG. 2 shows the secondary common rail, and the cross-section of the check valve and the upper part of the high pressure pump, according to a first embodiment of the present invention.

FIG. 1 shows the major configuration of a common-rail injection device according to a first embodiment of the present invention; FIG. 2 shows the secondary common rail, and the cross-section of the check valve and the upper part of the high pressure pump, according to a first embodiment of the present invention.

In the common-rail injection device as described in FIG. 1, the fuel oil reserved in a fuel tank 5 is suctioned into a high pressure pump 3 through a fuel filter 4 for filtering the fuel oil; a plurality of cylinders of the high pressure pump 3 pressurizes the fuel oil; the fuel oil pressurized by each cylinder enters a high pressure pipe 13 through a check valve 10, a connecting pipe (a high pressure pipe) 10*s* and a secondary common rail that are described later again; after passing through a high pressure pipe 13, the pressurized fuel oil enters a common rail 1 in which the high pressure of the fuel oil is preserved.

A fuel injection pipe 12 connects the common rail 1 to each fuel injector 6 fitted to each cylinder 7 of the engine; a fuel flow rate control valve 8 is provided at each fuel injection pipe 12, so that the fuel flow rate control valve 8 is opened every predetermined timing (or predetermined timings) for predetermined time duration, based on the order signals which a control device 11 issues according to the operating conditions regarding the engine and the firing timing regarding each cylinder of the engine; namely, when the control device 11 transmits an signal to open the fuel flow rate control valve 8, the fuel flow rate control valve 8 at each cylinder is opened so that the pressurized fuel oil in the common rail 1 is supplied to the corresponding fuel injector 6.

By transmitting, from the control device 11, an order signal for opening the fuel flow rate control valve 8 of each cylinder, the highly pressurized fuel oil in the common rail 1 can be injected into the corresponding cylinder 7.

In FIGS. 1 and 2, the high pressure pump 3 is provided with a plurality of cylinders (3 cylinders in this case); in each cylinder (i.e. a plunger sleeve) of the pump 3, a plunger 3*a* is inserted so as to perform slidable reciprocating movements by the driving movements of a tappet 3*c*; thus, the fuel oil in a delivery chamber 3*b* of the pump 3 is pressurized, and the fuel oil pressurized into a high pressure is supplied to a suction port 10*g* of the check valve 10 from the delivery chamber 3*b*.

As shown in FIG. 2, the check valve 10 is provided with a case 10*f* for housing the components of the check valve 10; the case 10 is fastened to a case (a high pressure pump body) 3*d* of the high pressure pump 3, by use of a plurality of bolts 10*d*; namely, the high pressure pump 3 and the check valve 10 form an integrated component.

As many as check valves 10 are provided as there are cylinders of the high pressure pump 3; when the pressure of the pressurized fuel oil becomes higher than or equal to a pressure established by a spring 10*b* and a valve body 10*a* that are housed in a spring chamber 10*c*, then the check valve 10 is opened, and the high pressure fuel oil can be allowed to enter the connecting pipe 10*s*; further, the check valve 10 prevents the high pressure fuel oil from back-flowing to the delivery chamber 3*b* from the connecting pipe 10*s*.

As described above, when the spring 10*b* and the valve body 10*a* move so as to open the check valve, then the pressurized fuel oil is sent to the secondary common rail 2 through the connecting pipe (the high pressure pipe) 10*s*.

The volume of the secondary common rail 2 is to be smaller than or equal to the volume of the common rail 1; it is preferable that the former is approximately smaller than or equal to a tenth of the latter. From the multiple cylinders (3 cylinders in this case) of the high pressure pump 3 that are arranged just below the secondary common rail 2 as described above, the high pressure fuel oil enters the secondary common rail 2 through the check valve 10

The secondary common rail 2 has a volume smaller than or equal to the volume of the common rail 1; the volume of the secondary common rail 2 is preferably smaller than or equal to a tenth level of the common rail 1; the high pressure fuel oil pumped from the high pressure pump 3 through the check valve 10 is sent to the secondary common rail 2; thereby, the pumping pressure vibrations of the high pressure fuel oil as well as the surge pressure vibrations due to the movements regarding the spring 10*b* and the valve body 10*a* of the check valve 10 work on the secondary common rail 2.

On the other hand, the number of connecting pipes (the high pressure pipes) 13 is one, the number being smaller than that of the check valves 10 or the cylinders of the high pressure pump.

According to the configuration of the first embodiment as described above, the fuel oil reserved in the fuel tank 5 is sucked into the high pressure pump 3 provided with 3 cylinders or multiple cylinders, after being filtered by the fuel filter 4. The high pressure fuel oil pressurized by each cylinder of the high pressure pump 3 enters the high pressure pipe 13, through the check valves 10, three connecting pipe 10*s* and one secondary common rail 2; after passing through the one high pressure pipe 13, the high pressure pipe oil enters the common rail 1, and the high pressure therein is accumulated.

Hence, according to the first embodiment as described above, the whole common rail device is provided with: the secondary common rail 2 that is connected the fuel outlet of each check valve 10 arranged at each cylinder of the high pressure pump 3 (total 3 cylinders in this example), the secondary common rail 2 having a volume smaller than or equal to the volume of the common rail 1; the high pressure pipe 13 that connects the fuel outlet of the secondary common rail 2 and the common rail 1; thereby, the number of high pressure pipes 13 (the number is one in this case) is set smaller than that of the check valves 10 that are provided at each of the cylinders in the high pressure pump 3 (the number of check valves is 3 in this case).

Thus, the pumping pressure vibrations of the high pressure fuel oil as well as the surge pressure vibrations due to the movements regarding the spring 10*b* and the valve body 10*a* of the check valve 10 are generated in the fuel oil delivered from the fuel outlet of each check valve 10; thereby, the pumping pressure vibrations are the pressure fluctuations which cycle relates to the numbers of cylinders of the high pressure pump 3 and the rotation speed of the high pressure pump 3. Further, the pumping pressure vibrations as well as the surge pressure vibrations are transmitted to the secondary common rail 2; thereby, the volume of the secondary common rail 2 is smaller than or equal to the volume of the common rail 1.

Further, as shown in FIG. 1, in the configuration, the number of connecting pipes (the high pressure pipes) 13 (i.e. one high pressure pipe in this case) is smaller than the number of cylinders of the high pressure pump (i.e. 3 cylinders in this case); thereby, the connecting pipe 13 connects the common rail 1 to the secondary common rail 2 that has a volume smaller than or equal to the volume of the common rail 1.

Accordingly, the cycle of the pumping pressure vibrations (fluctuations) transmitted to the fluid space in the secondary common rail 2 relates to the numbers of check valves 10 (3 cylinders in this case) of the high pressure pump 3 and the rotation speed of the high pressure pump 3. Thus, the pumping pressure fluctuations are transmitted to the common rail 1 via the secondary common rail 2 as well as via the high pressure pipe 13; thereby, the number of high pressure pipes 13 (i.e. one high pressure pipe in this case) is set smaller than the number of check valves 10 (i.e. 3 check valves in this case) arranged at the high pressure pump cylinders, and the high pressure pipe 13 has the small passage area.

As described above, the pressure fluctuations are transmitted to the secondary common rail 2 from the fuel inlet side, namely, from the high pressure pump cylinder side or the check valve side; thereby, the cycle of the pumping pressure fluctuations relates to the number of check valves 10 (3 cylinders in this case) of the high pressure pump 3 and the rotation speed of the high pressure pump 3. Further, the throttle area regarding the outlet side (i.e. the high pressure pipe 13) of the secondary common rail 2 is smaller than the throttle area regarding the inlet side of the secondary common rail 2; in addition, the number of high pressure pipes is smaller than the number of check valves; in this way, the fuel oil accompanying the pressure fluctuations is sent into the common rail 1 of a larger volume from the secondary common rail 2 of a smaller volume, via the high pressure pipe 13 with the small throat area.

Accordingly, the pressure fluctuation wave is absorbed in the secondary common rail 2; thereby, the pressure fluctuation wave corresponds to the numbers of check valves 10 (3 check valves in this case) fitted to the high pressure pump 3 and the rotation speed of the high pressure pump 3. After the fluctuation wave is absorbed in the secondary common rail 2, the fuel oil accompanying the pressure fluctuations is sent into the common rail 1, via the high pressure pipe 13 (one pipe 13 in this case), the number of pipes 13 being smaller than the number of the connecting pipes 10*s*.

As described above, in a simple and compact device where the secondary common rail 2 which volume is smaller than the volume of the common rail 1 is provided at the outlet sides of the check valves 10 regarding the high pressure pump 3 and the high pressure pipe 13 is provided so that the number of high pressure pipes 13 (i.e. one high pressure pipe in this case) is smaller than the number of check valves 10 fitted at each cylinder of the high pressure pump 3, the delivery pressure fluctuations regarding the high pressure pump 3 as well as the surge pressure vibrations regarding the check valves 10 can be prevented. Thus, the fuel oil can be supplied to the common rail 1 under a stable pressure condition.

Further, in the first embodiment as described above, a plurality of common rails 1 (e.g. 2 common rails) may be provided so that each common rail 1 is provided with a secondary common rail 2; thereby, each secondary common rail 2 is connected to the corresponding common rail 1 via at least one high pressure pipe 13; thereby, the number of high pressure pipes 13 is smaller than the number of check valves 10 of a high pressure pump 3, and each check valve 10 is connected to the corresponding secondary common rail 2.

In the manner as described above, by providing a secondary common rail 2 in response to each of at least one common rail 1, as well as, by supplying high pressure fuel oil accompanying pressure fluctuation wave from each secondary common rail 2 to the corresponding common rail 1 which volume is greater than the volume of the secondary common rail 2 via at least one high pressure pipe 13 (e.g. the number of high pressure pipes 13 is one) of the small throttle area, the pressure fluctuation wave (vibration) can be absorbed in each secondary common rail 2; after passing through each secondary common rail 2, the high pressure fuel oil can enter each common rail corresponding to the secondary common rail 2, the pressure fluctuations being smoothed.

Second Embodiment

Figure 3:
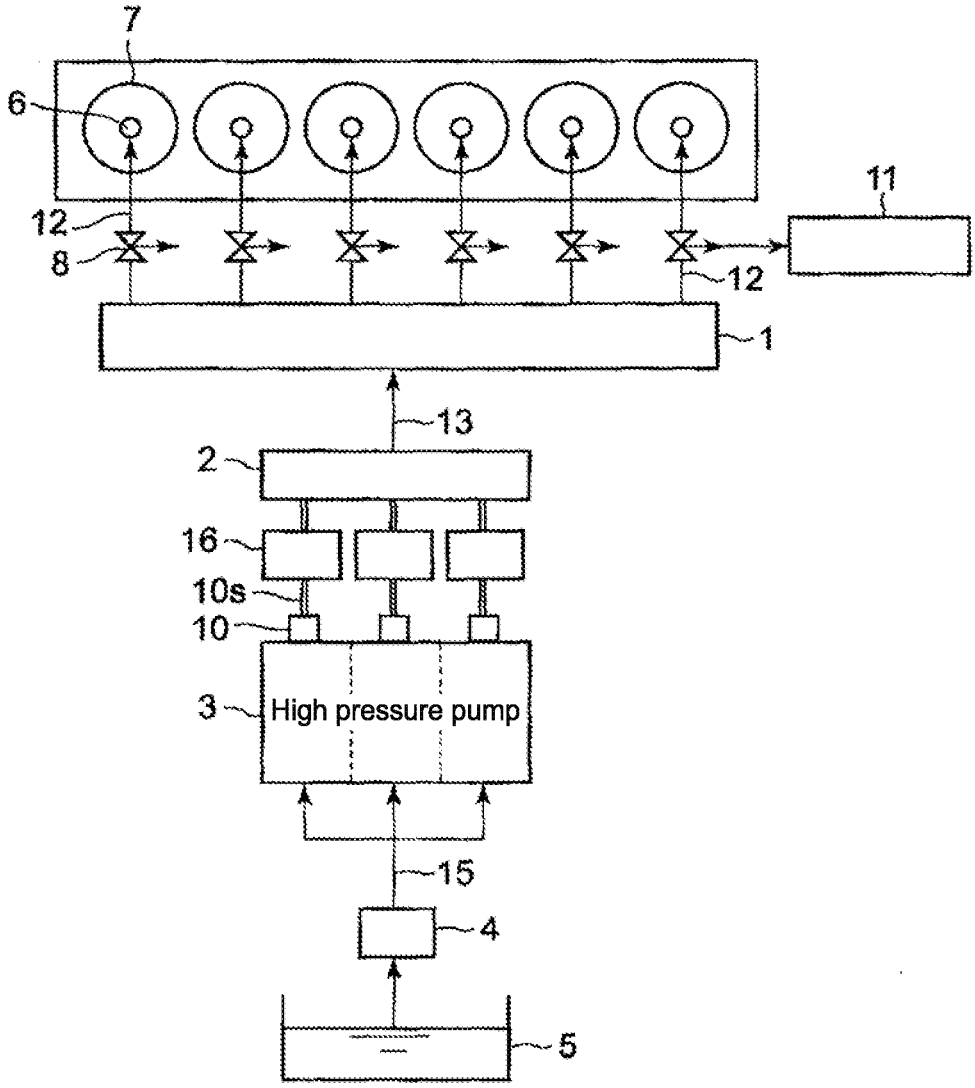
FIG. 3 shows the major configuration of a common-rail injection device according to a second embodiment of the present invention.

FIG. 3 shows the major configuration of a common rail injection device according to a second embodiment of the present invention; also in this second embodiment, the secondary common rail and the check valve that appear in the first embodiment or in FIG. 1 are used.

In the second embodiment, as depicted in FIG. 3, three pressure accumulation rooms 16 are provided (an pressure accumulation room per cylinder) between the outlet of each check valve 10 and the secondary common rail 2; in other words, three pressure accumulation rooms 16 for reducing the pumping pulsation regarding the high pressure fuel oil are provided in response to the number of check valves 10 (three check valves in this case), per high pressure pump.

The other configuration in FIG. 3 is the same as that in the first embodiment or in FIG. 1 or 2; the same numeral as in the first embodiment is given to the same component in the second embodiment As described above, with the configuration of the second embodiment, in the secondary common rail 2, the pressure fluctuation wave (vibration) derived from each check valve 10 corresponding to each cylinder of the high pressure pump is restrained; moreover, the pressure pulsation of the high pressure fuel oil is smoothed thanks to the volume effect of each pressure accumulation room; thus, the fuel oil can be sent to the common rail 1 from the secondary common rail 2.

Further, with the configuration of the second embodiment, three pressure accumulation rooms 16 can be configured as a set that integrate the rooms 16 with each check valve 10 corresponding to each cylinder of the high pressure pump 3

Third Embodiment

Figure 4:
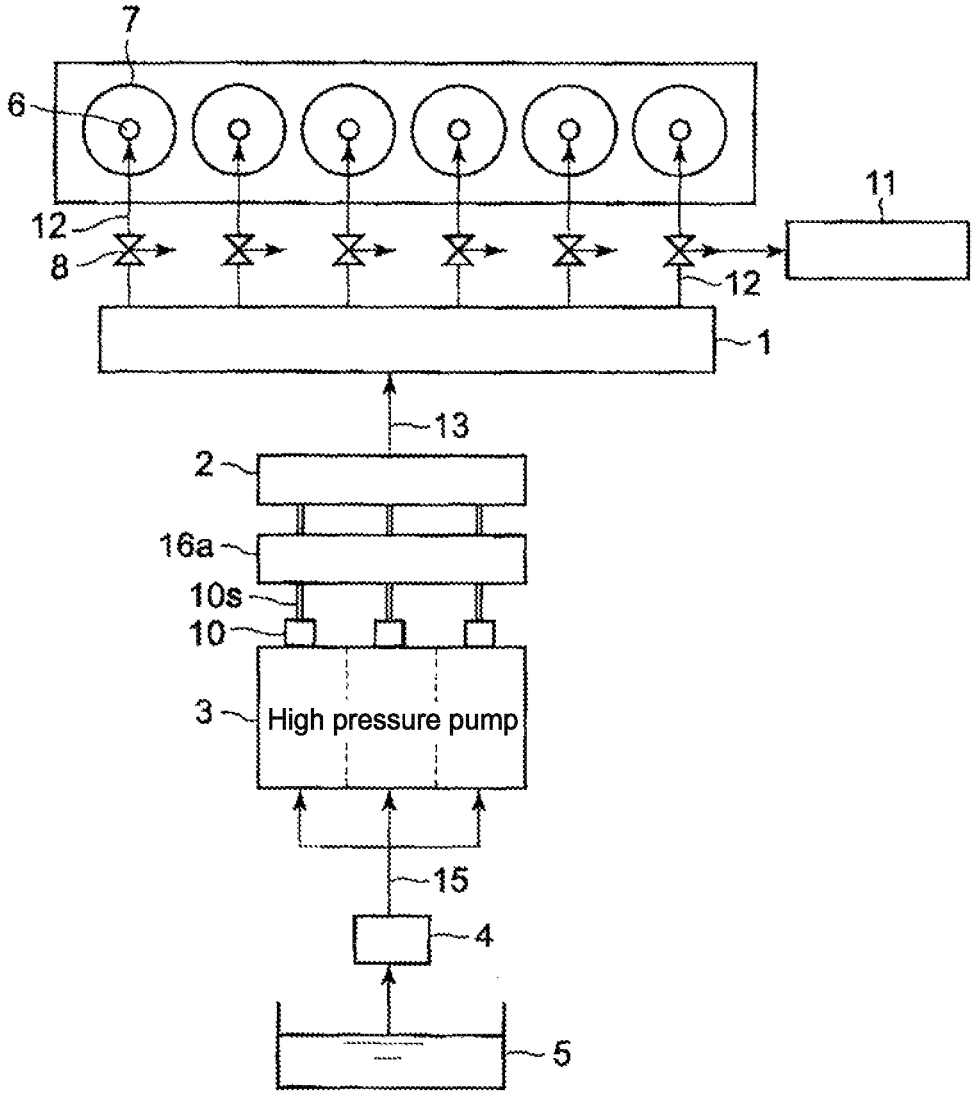
FIG. 4 shows the major configuration of a common-rail injection device according to a third embodiment of the present invention.
Figure 5B:
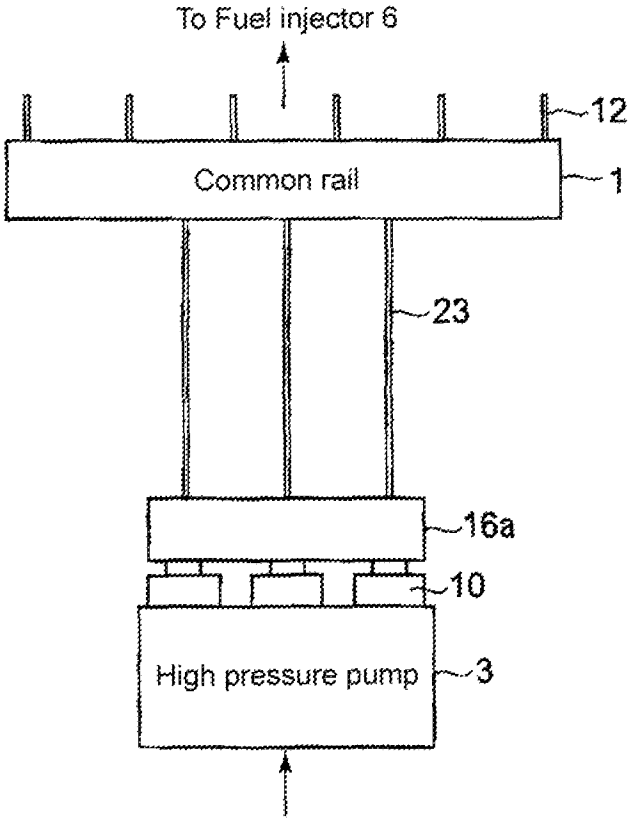
FIG. 5(B) shows a second example according to conventional technologies.
Figure 5A:
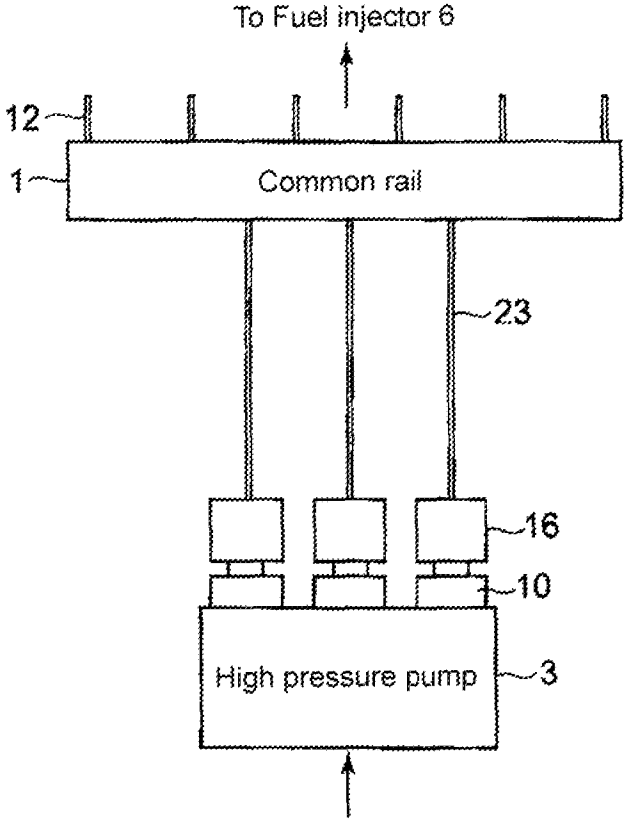
FIG. 5(A) shows a first example according to conventional technologies.
Figure 6:
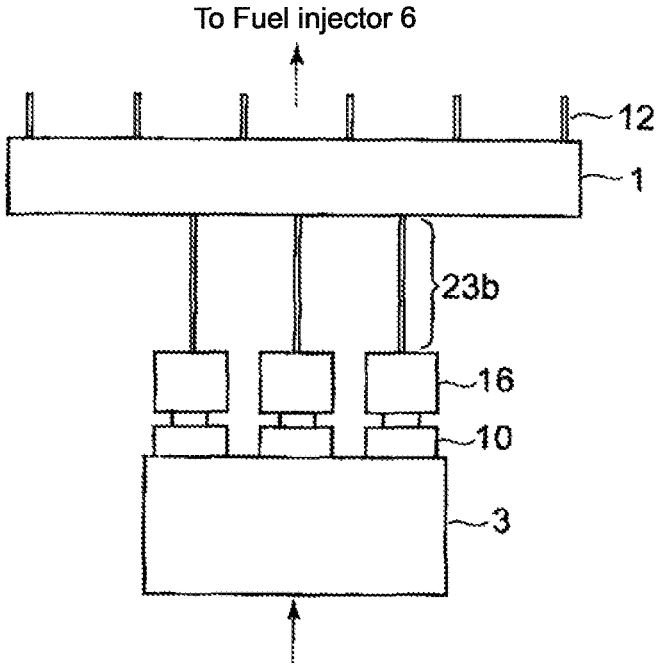
FIG. 6 shows a third example according to conventional technologies.
Figure 7:
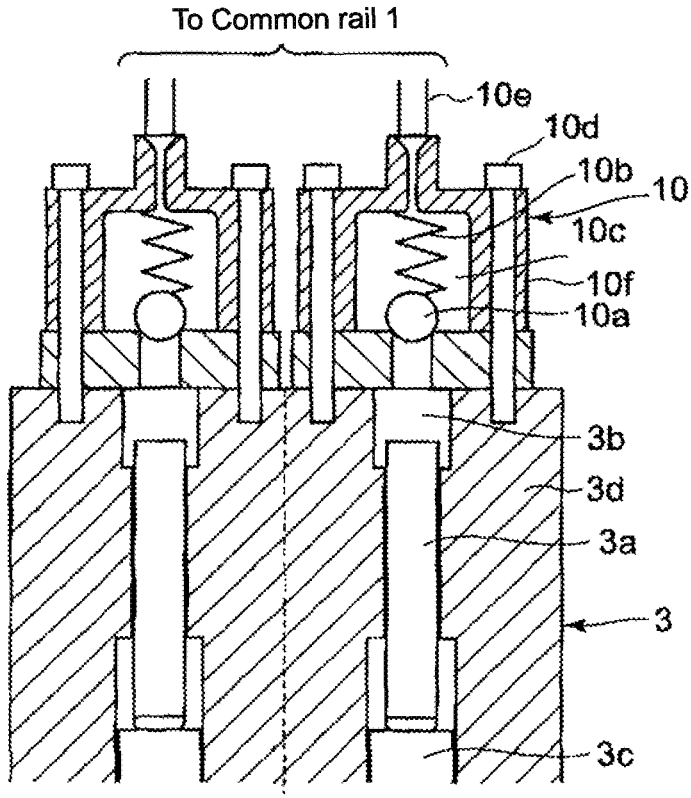
FIG. 7 shows a cross-section regarding the neighborhood of the high pressure pump and the check valve, according to conventional technologies.

FIG. 4 shows the major configuration of a common-rail injection device according to a third embodiment of the present invention. In this third embodiment, the secondary common rail and the check valve that appear in the first embodiment or in FIG. 1 are used.

In the third embodiment, the pressure accumulation rooms 16 are integrated in one volume per multiple outlets of check valves 10, each check valve being related to a cylinder of one high pressure pump 3; the integrated pressure accumulation room 16*a* common among the check valves is connected to the secondary common rail 2; namely, one integrated pressure accumulation room 16*a* per high pressure pump is provided.

In this way, since the multiple pressure accumulation rooms 16 are integrated into one pressure accumulation room 16*a* per high pressure pump 3 so that the pressure accumulation room 16*a* is formed as one volume, the integrated volume (the volume of the pressure accumulation room 16*a*) can be larger than the sum of the separated volumes; and, the pumping pulsation as well as the surging pressure vibration in the fuel oil sent to the common rail can be reduced.

INDUSTRIAL APPLICABILITY

According to the present invention, in the field of common rail fuel injection devices, a pressure fluctuation control device with a simple and compact configuration can be provided so as to control the pressure fluctuations in the upstream side of a common rail; thereby, the pumping pulsation generated by the movement of each cylinder of the high pressure pump as well as the surging pressure vibration generated by the pressure fluctuation working on the check valves can be controlled; and, the high pressure fuel oil can be supplied to the common rail under a stable pressure condition.

The invention claimed is:

1. A pressure fluctuation control device for controlling the pressure fluctuation in the upstream side of a common rail in an accumulator injection system, the device comprising:

a high pressure pump comprising a plurality of cylinders in which fuel oil is pressurized to a certain level of high pressure, and a check valve that is provided at a fuel outlet of each cylinder so as to open and close the fuel passage of the check valve;

a common rail that accumulates the pressurized fuel oil delivered by the high pressure pump; and a fuel injector that is provided at each cylinder of the engine so that a prescribed amount of the highly pressurized fuel oil accumulated in the common rail is injected into each cylinder of the engine through the fuel injector;

wherein the pressure fluctuation control device is further comprising:

a secondary common rail that is connected to the fuel outlet of the check valve corresponding to each cylinder of the high pressure pump, the accumulation volume being smaller than or equal to the accumulation volume of the common rail; and at least one high pressure pipe that connects the fuel outlet of the secondary common rail to the common rail, the number of high pressure pipes being smaller than the number of check valves corresponding to the cylinders of the high pressure pump.

2. The pressure fluctuation control device according to claim 1, wherein the device further comprising at least one common rail other than the already provided common rail, wherein each common rail is provided with the secondary common rail, and each secondary common rail is connected to the corresponding common rail via at least one high pressure pipe, the number of high pressure pipes being less than the number of the check valves provided to the cylinders of the high pressure pump.

3. The pressure fluctuation control device according to claim 1, the device further comprising at least one pressure accumulation room for reducing pumping pulsation of the pressurized fuel oil between the secondary common rail and the fuel outlet of the check valve provided to each cylinder of the high pressure pump.

4. The pressure fluctuation control device according to claim 3, wherein one pressure accumulation room is provided to each of the fuel outlet of the check valve provided to each cylinder of the high pressure pump, and each pressure accumulation room is connected to the secondary common rail.

5. The pressure fluctuation control device according to claim 3, wherein the pressure accumulation rooms are integrated into one volume for the multiple outlets of the check valves, and the integrated pressure accumulation room being common to the check valves is connected to the secondary common rail.

* * * * *